United States Patent [19]

Whitehead

[11] Patent Number: 4,618,167

[45] Date of Patent: Oct. 21, 1986

[54] SECURITY FILAMENT FOR USE IN IDENTIFICATION CARDS

[76] Inventor: Edwin N. Whitehead, 6208 Tally Ho La., Alexandria, Va. 22307

[21] Appl. No.: 578,650

[22] Filed: Feb. 9, 1984

[51] Int. Cl.[4] ..... B42D 15/00

[52] U.S. Cl. ..... 283/75; 283/904; 283/77; 283/57; 428/916; 428/110; 428/374

[58] Field of Search ..... 156/159, 309.6; 283/57, 283/77, 109, 112, 904, 75; 428/110, 374, 371, 377, 916

[56] References Cited

U.S. PATENT DOCUMENTS

| | | | |
|---|---|---|---|
| 2,448,782 | 9/1948 | Davis | 428/374 X |
| 2,835,993 | 5/1958 | Whitehead | 283/111 X |
| 3,622,429 | 11/1971 | Kippan | 428/110 |
| 4,097,279 | 6/1978 | Whitehead | 283/109 X |
| 4,183,989 | 1/1980 | Tooth | 428/195 |
| 4,290,630 | 9/1981 | Lee | 283/904 X |
| 4,371,196 | 2/1983 | Von Kempski et al. | 283/57 X |

*Primary Examiner*—Paul A. Bell

[57] ABSTRACT

A filament for use with identification cards to render them tamper and fraud resistant having a meltable core of twisted polymeric micro-filaments which is wrapped with metal foil in a manner to leave portions of the core exposed.

9 Claims, 3 Drawing Figures

SECURITY FILAMENT FOR USE IN IDENTIFICATION CARDS

The present invention relates to a security filament for identification cards and the like. More particularly, the invention relates to a filament having a multi-filamented polymeric core wrapped with metal foil particularly adapted for lamination between a cover and an indicia bearing substrate.

BACKGROUND OF THE INVENTION

A multiplicity of devices have been employed to deter or prevent alteration of photographic identification cards and other indicia containing substrates. More notably, protective devices for security identification cards, particularly those bearing a photograph of its holder, are employed to eliminate tampering or fraudulent alteration of the card, photograph or both.

Unprotected photographic images are rather simple targets for alteration. Should the forger wish to substitute a photograh of another individual for that originally contained on the card, a portion of the photograph can simply be excised from the card and substituted with a new image. One technique for hampering a forger includes the use of filaments placed across the face or some other portion of the security identification card. Often such filaments are laminated directly above the photograph or photographic likeness of the card holder to deter a forger from altering the card. Although providing some security against intentional tampering, a careful and intent forger can alter a card by excising the original photograph, substituting a new image therefor, and matching the alignment of substituted filament portions. Such changes in the hands of a skilled forger may be undetectable to the naked eye.

In order to improve tamper resisting characteristics of security cards, security filaments have been modified as depicted in the patent literature. For example, Von Kempski, U.S. Pat. No. 4,371,196, provides a filament with a structural cross-section. More specifically, the filament is composed of metal which includes notches thereon conforming to a predetermined code. This filament is generally laminated between a card cover and photograph of the card holder. An electronic coding system is used to determine whether or not the card has been altered. If altered, the code contained on the filament will probably not match that of the original, and, therefore, the forgery can be detected. Tooth, U.S. Pat. No. 4,183,989, discloses a polyester thread with two machine varifiable features. The polyester is coated with luminescent, X-ray absorbent, and/or metal magnetic material designed to be read by a sophisticated electronic device. These two patents are indicative of a trend which includes the use of elaborate detection systems to insure the integrity of security identification cards.

SUMMARY OF THE INVENTION

It is an object of this invention to provide a simple device insuring maximum security against alteration of an identification card.

It is another object of this invention to eliminate the need of complex adjunct electronic protective equipment.

Another object of this invention is to provide a security filament which protects vital information such as a photographic image or indicia.

Still another object of this invention is to provide a security filament which is complementary with and capable of lamination to clear polymeric materials generally associated with security cards.

Another object of this invention is to provide a security thread which flattens substantially upon application of pressure before heat so that filament is flat when heat arrives.

Still another object of this invention is to provide a filament which does not deform any surfaces upon lamination.

Yet another object of this invention is to provide a filament that, upon application of pressure and then heat incapable of alteration without detection.

These and other objects are satisfied by a filament positioned on the surface of an indicia bearing surface, the filament having a meltable core of twisted polymeric microfilaments which is wrapped with metal foil.

In order to realize the objects of the invention, experimentation was required to find a filament best suited for the invention. The chosen material was required to possess several characteristics. First, the material has to be formable into threads. Secondly, the material had to be compatible with commonly employed laminating materials used to cover identification cards. Thirdly, the material was required to possess specific characteristics upon melting. Lastly, it was desired to find a material that would melt under the particular conditions used for lamination.

At first, solid, plasticized polyvinyl chloride thread was used. Upon lamination, it was found that the plasticized thread melted before the sealing of the polymeric covers was completed. Therefore, the melted threads flowed in an irregular manner yielding an unattractive and unreproducible product. Because the plasticized product behaved so poorly upon lamination, another series of experiments was carried out with unplasticized polyvinyl chloride (hereinafter PVC) threads. Solid threads having a diameter of approximately 8 mils were laminated between polymeric card covers. It was found that the hard, solid thread softened at a much slower rate than the covers and as a result formed an indenture in the covers. After cooling, these indentures caused the laminated product to break upon flexing. Since this deformity would prove wholly unacceptable for cards used in their intended environment, an alternative thread material was required.

It was determined that a compromise between the too fast melting plasticized PVC thread and the too slow melting unplasticized PVC thread had to be found. I, therefore, obtained very fine filaments of unplasticized PVC and twisted them into a thread having a diameter of approximately 5 mils. When tested, these threads possessed the desired characteristics. The thread flattened and melted in a uniform manner upon lamination and neither created indentures in the plastic covers nor flowed irregularly. Thus, the twisted fine filaments provided the necessary properties for the invention.

DETAILED DESCRIPTION OF THE DRAWINGS

Figure 1:
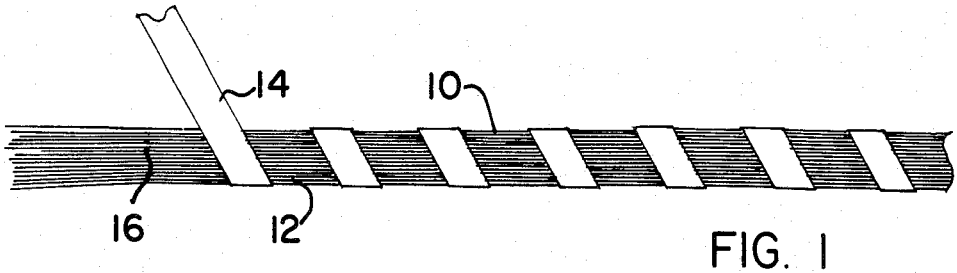
FIG. 1 is a view of one preferred embodiment of the invention and illustrates the components thereof.

Security filament 10 shown in FIG. 1 is composed of meltable core 12 and spirally wrapped metal foil 14. Core 12 is manufactured from unplasticized black PVC in the form of microfilaments 16 twisted together to form a thread. In the preferred embodiment, the diameter of core 12 is approximately 5 mils. An estimated fifty microfilaments are required to achieve this diameter. Core 12 is wrapped in a helical fashion by metal foil 14. Metal foil 14 may be composed of any appropriate materials. Preferably, a malleable material such as gold or silver is employed. More preferably, in order to reduce costs, aluminum foil anodized with gold is used. A thin strip or thread of the metal foil having a thickness of 4 mil or less and a width of approximately 20 mils is continuously wrapped in a spiral manner around core 12, yielding a filament with a diameter of approximately 12 mils. Where spaces are provided between each spiral, core 12 is, therefore, left partially exposed.

Figure 2:
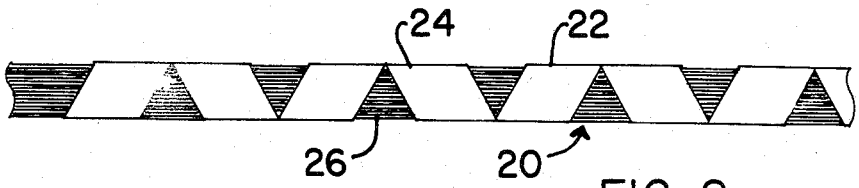
FIG. 2 depicts a second preferred embodiment of the invention.

FIG. 2 depicts a second preferred embodiment of a security filament 20 contemplated by this invention. Security filament 20 includes core 26 composed of the same microfilaments 16 as found in the first preferred embodiment. In this embodiment, core 26 is wrapped with two oppositely directed metal foil threads in a spaced helical configuration. The PVC thread core 26 is partially exposed in the same manner core 12 is exposed in FIG. 1.

Figure 3:
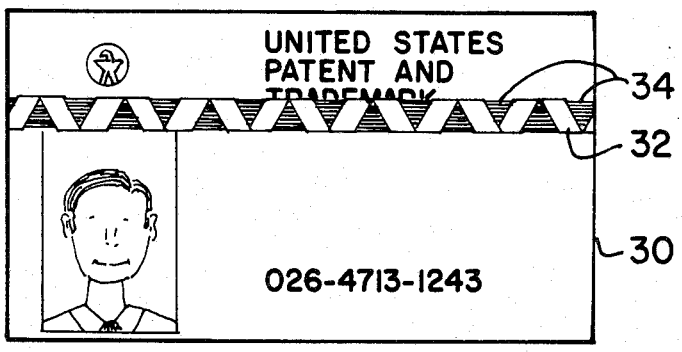
FIG. 3 is a frontal view of an identification card cover having the security filament laminated therein.

FIG. 3 illustrates a security filament substantially similar to that illustrated in FIG. 1, laminated to an appropriate identification card cover. A hydraulic hot platen press at 350° F. and generating 500–1000 psi pressure are preferred for lamination of the invention. Upon lamination, the filament is substantially flattened to a width of approximately 10 mil. While being subjected to the pressure and heat of lamination, a PVC core melts to give appearance of black dots 34 filling the voids between zig-zagging, V-shaped, flattened metal foil 32. Due to the unusual pattern created by the laminated security filament, alternation or tampering with either the filament or the security card underlying the filament will result in the formation of discontinuities of the geometric pattern. For this reason, mere visual inspection of the identification card, without the need for elaborate detection or decoding devices, can determine if the card has been altered. When located over a photographic image of the holder, any tampering with either the picture or the laminated security filament will become obvious to the naked eye.

The preferred material composing the card covers is a clear PVC film. However, other appropriate materials for lamination as disclosed in my U.S. Pat. No. 4,097,279, such as vinyl acetate or cellulose acetate and copolymers thereof may be employed successfully.

In practice, these security filaments are not used immediately upon manufacture. Therefore, it is desirable to provide proper storage means. The filaments are adhered to a carrier with an adhesive and then cut to an appropriate length (usually the length of the rest of the components (4″) of the unlaminated card). Alternatively, the filaments may be adhered directly to a cover to be used in card production. The adhesive selected for either process cannot affect the integrity of the filament, cover or carrier, but must be sufficiently strong to hold the filaments in place. An adhesive composition of n-butyl methacrylate resin dissolved in either methylene chloride or carbon tetra chloride provides such an adhesive. DuPont produces n-butyl methacrylate resin under the tradename "Elvacite" 2044 satisfactory for this purpose.

The filaments are dipped in a bath containing 56 gm n-butyl methacrylate and 180 ml solvent, placed on the selected surface and exposed to a heater roller at 150° F. (66° C.) in a drying oven. The solvent evaporates quickly and leaves the thread adhered to the surface. When a carrier sheet issued, the n-butyl methacrylate adhesive allows the filament to be glued to a carrier (5 mil PVC sheet) placed in position over the photograph prior to lamination. After lamination the filaments bond to the surface of the photograph.

These and other embodiments within the spirit and scope of the following claims should now be apparent to the skilled artisan.

I claim:

1. A security identification card, comprising (a) an indicia bearing surface, (b) a filament positioned on at least a portion of said surfce, said filament comprising a core of twisted unplasticized polyvinyl chloride microfilaments and metal foil spirally wrapped around said core to provide a substantially uniform spacing between the helicies of said spiral wrapping, (c) a clear, transparent, polymeric cover where the heat and pressure of lamination flatten said foil, melt said core and form an integral body.

2. A security filament for placement on and lamination to an indicia bearing surface, comprising:

polymeric microfilaments twisted together into a core, said core bearing meltable and flowable in a uniform and regular manner at conditions equivalent to approximately 121° C. (350° F.) and 500–1000 psi pressure, and malleable metal foil continuously wrapped in a spiral manner around and exposing spaced portions of said core, whereby subjecting said foil wrapped core to conditions substantially equivalent to 121° C. and 500–1000 psi pressure flattens said foil and causes said core to melt and flow uniformly.

3. A security filament according to claim 2 where the diameter of said core is approximately 5 mils and the thickness of said foil is approximately 4 mils.

4. A security filament according to claim 2 where said microfilaments are composed of unplasticized polyvinyl chloride.

5. A security filament according to claim 4 where said core has a diameter of approximately 5 mils and is composed of approximately fifty microfilaments.

6. In combination:

an indicia bearing surface; and a filament for positioning thereover and lamination to said surface at lamination conditions approximating 121° C. and 500–1000 psi pressure, said filament comprising a core of twisted polymeric microfilaments which melt and substantially uniformly flow at said lamination conditions and thin, metal foil strip spirally wrapped around said core in a manner where regularly spaced portions of said core are exposed whereupon exposing said filament positioned on said surface to said lamination conditions causes said foil strip to flatten and melts said core which substantially uniformly flows onto said surface.

7. A combination according to claim 6 where said metal foil is 4 mil thick aluminum foil.

8. A combination according to claim 7 where said foil is anodized with gold.

9. A combination according to claim 8 where said core is composed essentially of unplasticized polyvinyl chloride.

* * * * *